United States Patent [19]

Brence

[11] Patent Number: 4,951,480

[45] Date of Patent: Aug. 28, 1990

[54] EVAPORATIVE COOLING DEVICE AND PROCESS

[76] Inventor: Anton C. Brence, 18118 NW. Walker Rd., #B, Beaverton, Oreg. 97006

[21] Appl. No.: 275,436

[22] Filed: Nov. 23, 1988

[51] Int. Cl.[5] ..... F28D 5/00

[52] U.S. Cl. ..... 62/304; 62/314; 98/42.07

[58] Field of Search ..... 62/235.1, 260, 304, 62/309, 311; 98/42.07

[56] References Cited

U.S. PATENT DOCUMENTS

| | | | |
|---|---|---|---|
| 416,405 | 12/1889 | Fouquet . | |
| 1,297,633 | 3/1919 | Ashley | 62/260 |
| 2,464,766 | 3/1949 | Pennington . | |
| 3,747,362 | 7/1973 | Mercer . | |
| 4,043,777 | 8/1977 | Parren . | |
| 4,066,118 | 1/1978 | Goettl | 62/235.1 |
| 4,597,272 | 7/1986 | Marx II et al. | 62/304 |

*Primary Examiner*—Henry A. Bennet
*Attorney, Agent, or Firm*—Thaddius J. Carvis

[57] ABSTRACT

An evaporative cooling unit is provided which fits within a building wall. The evaporative cooling unit includes a remote fan which pulls air through the unit into a space to be cooled and also exhausts warm air from the space.

11 Claims, 3 Drawing Sheets

EVAPORATIVE COOLING DEVICE AND PROCESS

TECHNICAL FIELD

This invention relates generally to cooling systems, and more particularly to evaporative cooling systems.

Cooling systems which cool air by humidifying it are known in the art. Hot, dry air is humidified by evaporation as it passes through a moist water-wettable pad such as a standard "excelsior" unit. The water consumes heat energy as it evaporates and thereby cools the air passing through the pad.

Evaporative cooling units, however, are typically large and cumbersome. They are often mounted on roofs or in backyards and may require elaborate and expensive duct work to circulate cool air. Further, they may cause aural or visual disturbances and are thus shunned by home builders, homeowners, and others sensitive to such intrusions upon privacy. Prior art units may, additionally, require monitoring of a water level to maintain relatively continuous cooling.

BACKGROUND ART

Evaporative cooling systems having a variety of features are known in the art. The following U.S. Patents illustrate, by way of example only, several prior art systems.

U.S. Pat. No. 416,405 to Fouquet discloses an air-cooling apparatus for placement in an open door, window, or other air-inlet. The apparatus includes ice baskets and moistened fabrics.

U.S. Pat. No. 2,464,766 to Pennington discloses an air conditioner having circular excelsior pads which rotate at about three revolutions per minute. Pennington further teaches psychrometric cooling.

U.S. Pat. No. 3,747,362 to Mercer discloses an evaporative cooling system with a refrigeration unit which pre-cools water used to moisten a cooling pad.

U.S. Pat. No. 4,043,777 to Parren discloses an air handling unit which combines evaporative and refrigerative cooling with an exhaust unit. Cool air is delivered to and warm air is returned from a room via ducts.

Unfortunately, the prior art evaporative cooling systems are large bulky and often expensive units which may cause a visual or aural disturbance in residential or other design-sensitive structures. Prior art systems which incorporate ducts may suffer an additional disadvantage of lower efficiency because cool air may pass through ducts located in warm attics and walls before reaching a room to be cooled.

DISCLOSURE OF INVENTION

This invention relates to an evaporative cooling device which fits within a standard residential wall. The device includes a louvered exterior opening to reduce visual obtrusiveness, and a remote fan to reduce aural intrusiveness.

The process of this invention includes mounting an evaporative cooling device in one wall of an enclosed space to be cooled and mounting a fan in another wall of the enclosed space. The fan serves both to draw cool air into the enclosed space and to exhaust warm air from the enclosed space.

It is an object of this invention to provide an evaporative cooling unit which fits within a building wall. It is a further object of this invention to provide an evaporative cooling system which reduces visual and aural disturbance.

BRIEF DESCRIPTION OF THE DRAWINGS

These and other objects of the invention will become more apparent from the following detailed description when considered in conjunction with the accompanying drawings wherein.

FIG . 3 is a partial enlargement of FIG. 2 depicting additional detail of the evaporative cooling unit.

BEST MODE FOR CARRYING OUT THE INVENTION

Figure 1:
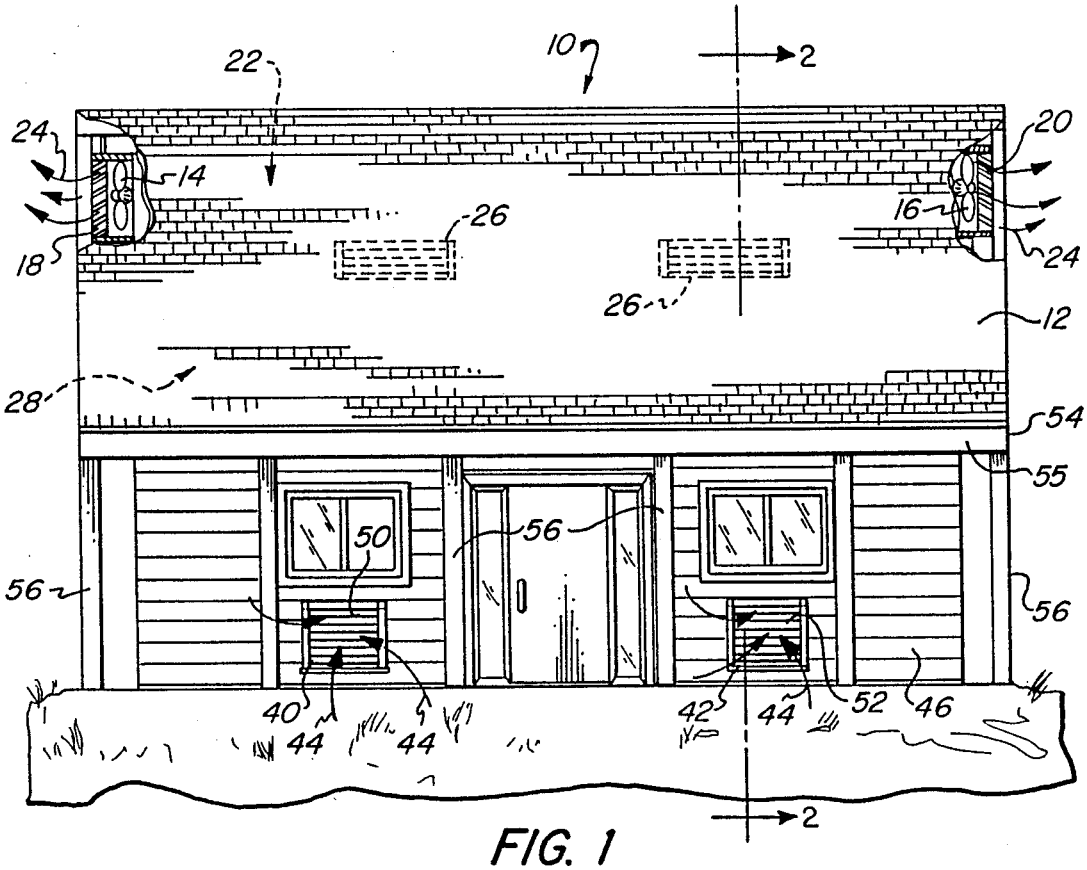
FIG. 1 is a partially cut-away front elevational view of a house including an evaporative cooling system of this invention.

With reference to the drawings and especially FIG. 1, a house or residence 10 incorporating in evaporative cooling system of this invention is shown. Evaporative cooling systems have their greatest utility in hot, dry climates like the Southwestern United States. In such climates the inside temperature of an enclosed space can be made lower than the outside temperature by increasing the humidity within the enclosed space. Because the outside air is characteristically dry it can be cooled without creating uncomfortable humidity.

A sloping roof 12 of house 10 is partially cut-away to reveal exhaust fans 14 and 16 mounted at either end of an attic 22 in house 10. Although only a single fan is necessary, a plurality of exhaust fans 14 and 16 are shown expelling air from attic 22 through louvered openings 18 and 20 as indicated by air flow lines 24. The exhaust fans are preferably mounted as high in attic 22 as possible in order to expel to the warmest air from house 10. Also, the more remote the exhaust fans are located from the living space, the less acoustic disturbance they will create.

Vents 26 shown in dashed lines are located beneath sloping roof 12. Vents 26 serve as passageways for air to flow from a living space 28 into attic 22 located substantially above living space 28. Further, the vents are preferably located relatively high in the living space in order to pass the warmest air into the attic.

Air is drawn into living space 28 from outside house 10 through evaporative cooling units 40 and 42 along air flow lines indicated at 44. Evaporative cooling units 40 and 42 are located within an exterior wall 46 of house 10. Louvered outside openings 50 and 52 of the evaporative cooling units are substantially shielded from direct sunlight by an overhang 54 extending from roof 12 of house 10. Overhang 54 is supported at an outward edge 55 by vertical posts 56.

Figure 2:
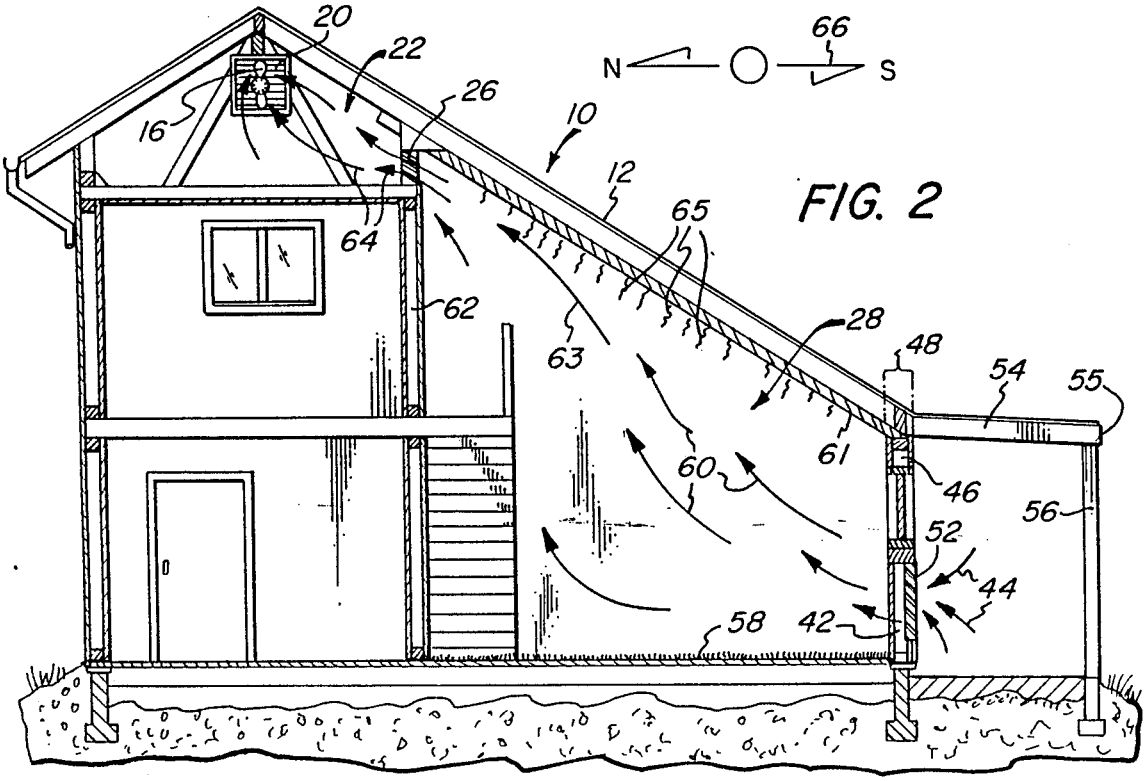
FIG. 2 is a side cross-sectional view of the house in FIG. 1.

FIG. 2 is a cross section taken along plane 2–2 in FIG. 1. FIG. 2 depicts the flow of air from outdoors through exterior wall 46 and into house 10. Exterior wall 46 is of a standard residential thickness, indicated at 48, of typically 5–7 inches. From air flow lines 44, air is pulled through louvered opening 52 and into evaporative cooling unit 42 which is preferably located near a floor 58 of house 10. Once inside evaporative cooling unit 42, air is cooled by a device discussed below in conjunction with FIGS. 3 and 4. A flow of cool air indicated at cool air flow lines 60 circulates through living space 28 to cool house 10.

As the cool air warms, it rises in living space 28 toward a sloping ceiling 61. Sloping ceiling 61 lies directly beneath sloping roof 12 and because of their proximity both are apt to become quite warm in the afternoon sun. Air lying just below sloping ceiling 61 will rise ever more rapidly, as indicated at air flow line 63, as it is radiantly warmed as indicated at 65 by sloping ceiling 61. Sloping roof 12 and sloping ceiling 61 may advantageously be aligned with a southerly exposure, as indicated at 66, to further increase convection of air within home 10.

Finally, warmed air 63 is drawn into attic 22 through vent 26, along air flow lines indicated at 64, and expelled from house 10 with exhaust fan 16. Vents 26 are preferably located high in an interior wall 62 of living space 28 in order to exhaust the warmest air from the living space.

Figure 3:
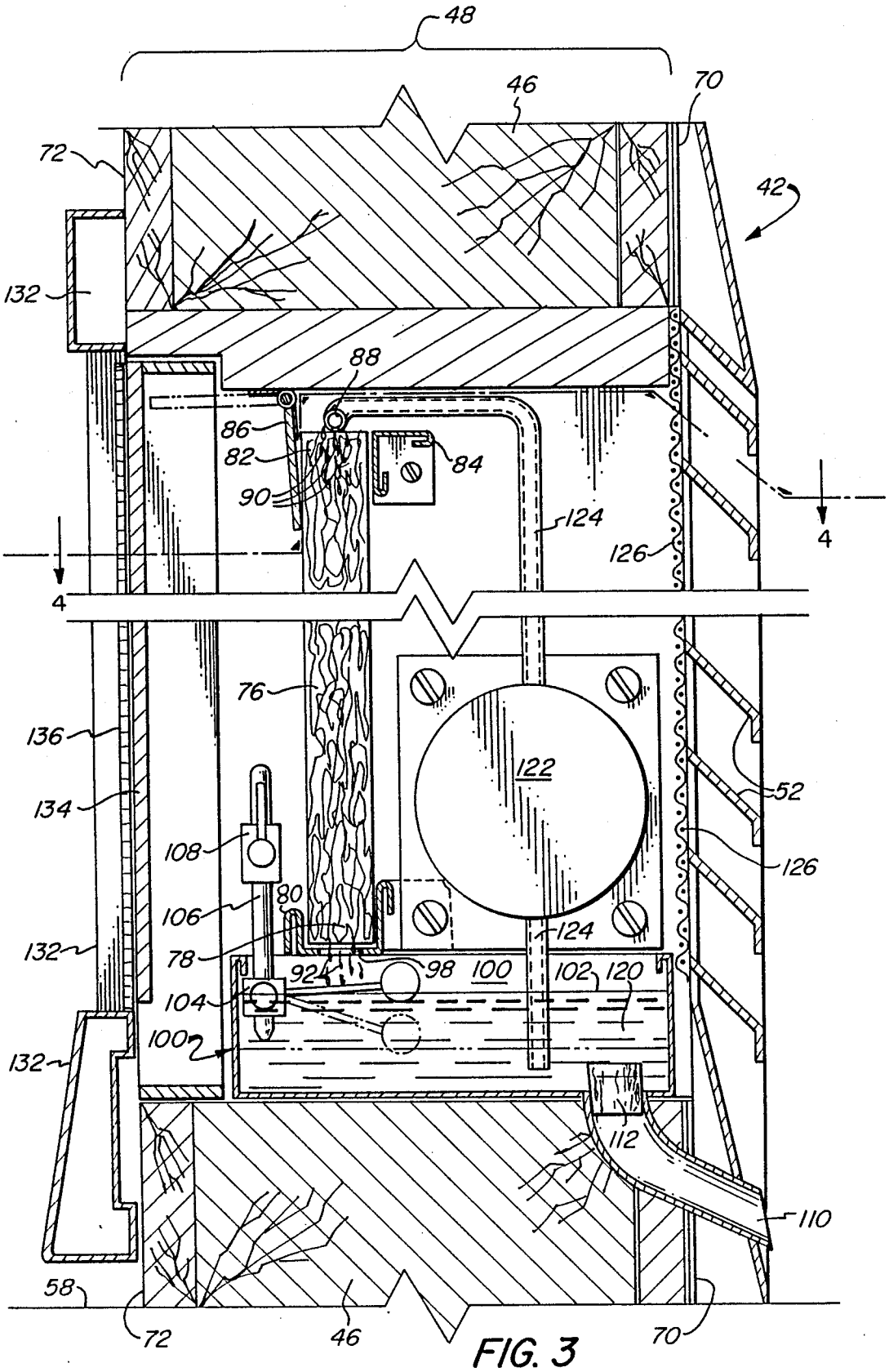

FIG. 3 is a partial enlargement of the cross sectional view of FIG. 2 revealment additional detail of evaporative cooling unit 42. Evaporative cooling unit 42 is mounted between an outside surface 70 and an inside surface 72 of exterior wall 46.

A water-wettable, air-permeable element 76 humidifies air from outdoors which passes therethrough as it is drawn into living space 28. Element 76 may be conveniently provided as a standard "excelsior" unit. A bottom edge 78 of element 76 rests in a trough 80, while a top edge 82 of element 76 is spring biased against a bracket 84 with at least one clip 86. Element 76 is wetted by a perforated pipe 88 which traverses top edge 82 to dampen element 76. Substantially vertical alignment at element 76 permits water 90 delivered at top edge 82 to seep to bottom edge 78. Excess water 92 drips from element 76 through a hole 98 in trough 80 and into a sump 100.

Sump 100 is slightly longer and wider than element 76 in order to collect all excess water 92 which drips through hole 98. Water level 102 of sump 100 is automatically controlled by a float valve 104 operatively attached to a water line 106. Water line 106 is also preferably provided with an on-off valve 108, for example a simple petcock, to prevent freezing in winter. Sump 100 may be emptied through drain pipe 110 by pulling cork 112. Water 120 is recirculated from sump 100 to perforated pipe 88 by a pump 122 through a pipe 124. Operation of pump 122 may be controlled by a switch, but is preferably automatically controlled by a timer, humidistat, or like device.

In use, outdoor air passes into evaporative cooling unit 42 through louvers 52 which visually disguise it, and through a screen 126 which prevents insects or other particulate matter from entering living space 28. The outdoor air is then drawn through element 76 and humidified. On extremely hot and dry days, a small portable fan may be placed directly in front of the unit to provide additional cooling.

Element 76 may be of any size necessary to properly humidify the enclosed space desired to be cooled. In the illustrated evaporative cooling system, evaporative cooling units 40 and 42 are about 3×3 feet.

Figure 4:
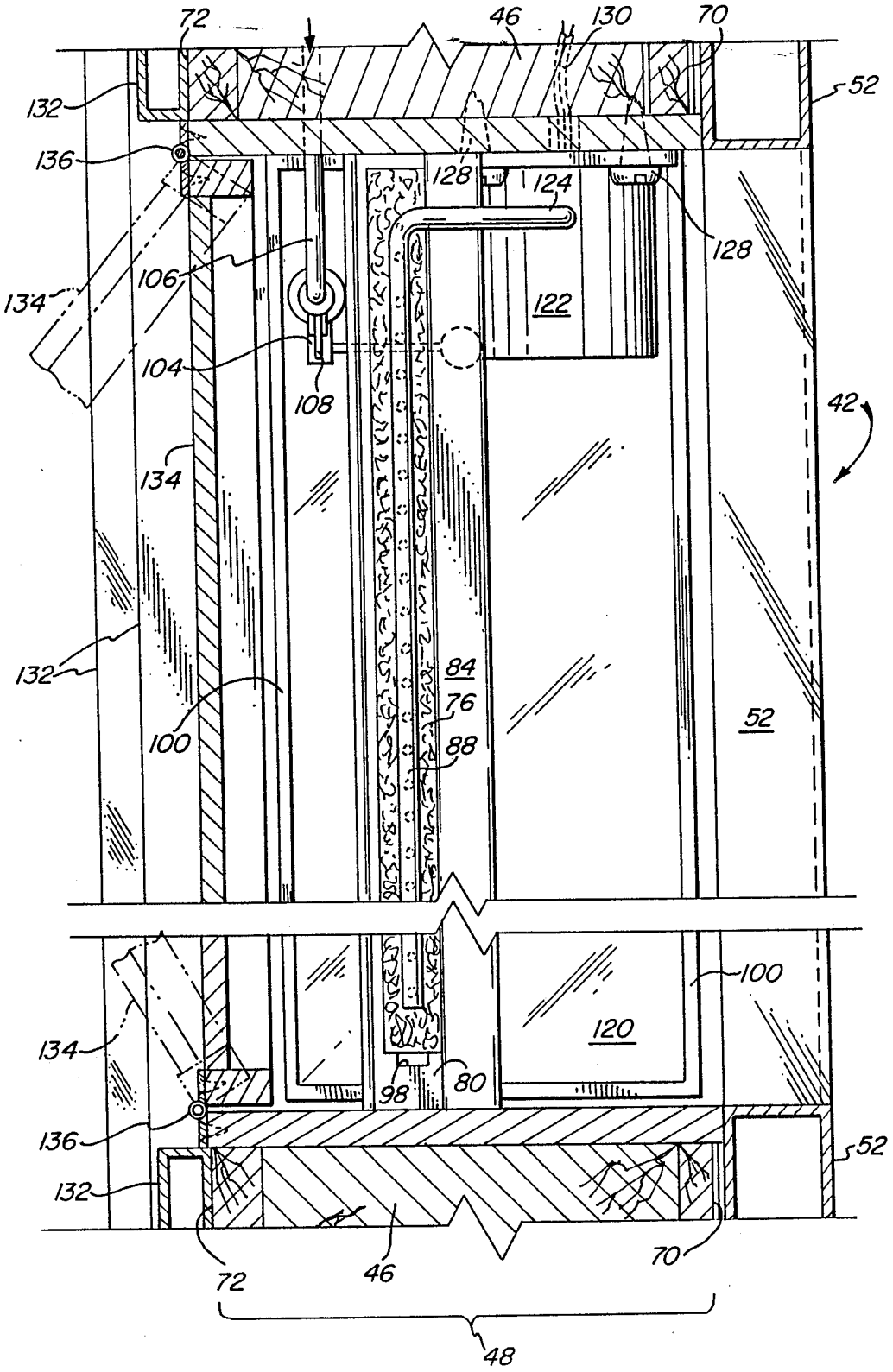
FIG. 4 is a top cross-sectional view of the evaporative cooling unit in FIG. 3.

FIG. 4 is a cross section taken along plane 4—4 in FIG. 3. Evaporative cooling unit 42 is shown in a top view in FIG. 4 to illustrate the relative position of various components. Pump 122 is shown mounted to exterior wall 46 by screws 128. Further, pump 122 is operable along lines 130. Additional detail includes interior trim 132 and doors 134 which hide evaporative cooling unit 42 from view when not in use. The doors also enable the evaporative cooling unit to be easily cleaned and serviced. Doors 134 are mounted to inside surface 72 of wall 46 with piano hinges 136.

The above description is not meant to describe in detail each and every modification and variation which will be apparent to a person skilled in the art. It is, however, meant to include all such modifications and variations within the scope of the following claims.

I claim:

1. A process for cooling a living space having a sloping ceiling comprising the steps of:

providing an evaporative cooling unit mounted relatively low and completely within an exterior wall of the living space;

shading an outside opening of the evaporative cooling unit from direct sunlight;

pulling air from outside into the evaporative cooling unit with at least one remote fan;

humidifying the outside air with the evaporative cooling unit to cooling it;

circulating the cooled air through the living space with the remote fan to cool the living space;

as the cooled air warms and rises toward the sloping ceiling, drawing it along the sloping ceiling toward a vent high in a wall of the living space with the remote fan; and exhausting the warm air from the living space with the remote fan.

2. The process of claim 1 wherein the humidifying step further comprises passing the outside air through a water-wettable element to humidify it.

3. The process of claim 1 wherein the sloping ceiling is covered by a sloping roof which is aligned with a southerly exposure.

4. The process of claim 3, further comprising the step of heating air near the sloping ceiling by radiation to convect the warm air in the living space along the sloping ceiling toward the vent.

5. The process of claim 1 wherein the exterior wall is shaded by an overhang extending from the sloping roof of the house.

6. An evaporative cooling unit comprising:

a water-wettable air-permeable element through which air may be passed for cooling, the element being aligned between an inside surface and an outside surface of a standard residential wall;

a perforated pipe for running across a top edge of the element to wet the element with water, the perforated pipe being closed at one end, the perforated pipe further being located between the surfaces of the standard residential wall;

a sump entirely located between the surfaces of the standard residential wall beneath a bottom edge of the element, the sump for receiving and containing excess water which drips from the element; and means located between the surfaces of the standard residential wall for pumping water from the sump to the perforated pipe for wetting the element.

7. The evaporative cooling unit of claim 6, further comprising a fan for pulling air from outside the standard residential wall through an opening in the outside surface, the element, and an opening in the inside surface into a room to be cooled, the fan being remote from the evaporative cooling unit to reduce acoustic disturbance created by the fan within the room to be cooled.

8. The evaporative cooling unit of claim 6 wherein the sump further comprises a float valve operatively connected to a water line for automatically filling the sump to a predetermined level as water evaporates from both the element and the sump to maintain relatively continuous cooling.

9. The evaporative cooling unit of claim 6, further comprising a plurality of louvers mounted over the first vent on the outside surface of the standard residential wall to visually screen the evaporative cooling unit, and a screen to prevent particulate matter from entering the room to be cooled.

10. The evaporative cooling unit of claim 6, further comprising a door on the inside surface of the standard residential wall to close the second vent, and further to visually screen the evaporative cooling unit when not in use.

11. The evaporative cooling unit of claim 6 wherein the sump further comprises a drain for emptying the sump.

* * * * *